US008351641B2

(12) United States Patent
Hao et al.

(10) Patent No.: US 8,351,641 B2
(45) Date of Patent: Jan. 8, 2013

(54) PORTABLE SOUND BOX

(75) Inventors: Ju-Lan Hao, Shenzhen (CN); Man-Zhong Wang, Shenzhen (CN); Te-Hua Lee, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 283 days.

(21) Appl. No.: 12/815,328

(22) Filed: Jun. 14, 2010

(65) Prior Publication Data

US 2011/0075877 A1 Mar. 31, 2011

(30) Foreign Application Priority Data

Sep. 29, 2009 (CN) ..... 2009 1 0307960

(51) Int. Cl.
*H04R 1/02* (2006.01)

(52) U.S. Cl. ..... 381/394; 181/198

(58) Field of Classification Search ..... 181/198, 181/199; 381/394
See application file for complete search history.

(56) References Cited

U.S. PATENT DOCUMENTS

| | | | | | |
|---|---|---|---|---|---|
| 4,168,761 | A * | 9/1979 | Pappanikolaou | 181/156 |
| 4,298,087 | A * | 11/1981 | Launay | 181/153 |
| 5,010,977 | A * | 4/1991 | Furukawa et al. | 381/96 |
| 5,361,459 | A | 11/1994 | Hyvonen et al. | |
| 5,821,471 | A * | 10/1998 | McCuller | 181/156 |
| 6,062,338 | A * | 5/2000 | Thompson | 181/152 |
| 6,618,488 | B2 * | 9/2003 | Nakamura | 381/349 |
| 7,894,620 | B2 * | 2/2011 | Yang | 381/345 |
| 8,009,850 | B2 * | 8/2011 | Zhou et al. | 381/345 |
| 2001/0005422 | A1 * | 6/2001 | Nakamura | 381/349 |
| 2008/0159554 | A1 * | 7/2008 | Sung et al. | 381/71.6 |
| 2009/0175483 | A1 * | 7/2009 | Huang | 381/386 |
| 2009/0257612 | A1 * | 10/2009 | Lin | 381/345 |
| 2011/0243359 | A1 * | 10/2011 | Lin et al. | 381/338 |

FOREIGN PATENT DOCUMENTS

CN 2852579 Y 12/2006

* cited by examiner

*Primary Examiner* — Jeffrey Donels
(74) *Attorney, Agent, or Firm* — Altis Law Group, Inc.

(57) ABSTRACT

A portable sound box includes a main body and a clip. The main body includes a battery for supplying power to the portable sound box. Thus, the portable sound box can supply power on its own. The clip is fixed to the main body and configured for clipping to an external object. Thus, the portable sound box can attached to the external object instead of standing on a surface.

10 Claims, 4 Drawing Sheets

PORTABLE SOUND BOX

BACKGROUND

1. Technical Field

The present disclosure relates to a portable sound box.

2. Description of Related Art

In use, sound boxes need to be placed on a horizontal supporting surface, such as the floor or a desktop, and connected to a local power source, and thus their portability is limited.

Therefore, it is desirable to provide a sound box, which can overcome the above-mentioned limitations.

BRIEF DESCRIPTION OF THE DRAWINGS

Many aspects of the present sound box should be better understood with reference to the following drawings. The components in the drawings are not necessarily drawn to scale, the emphasis instead being placed upon clearly illustrating the principles of the present sound box. Moreover, in the drawings, like reference numerals designate corresponding parts throughout the several views.

DETAILED DESCRIPTION

Embodiments of the present sound box will now be described in detail with reference to the drawings.

Figure 1:
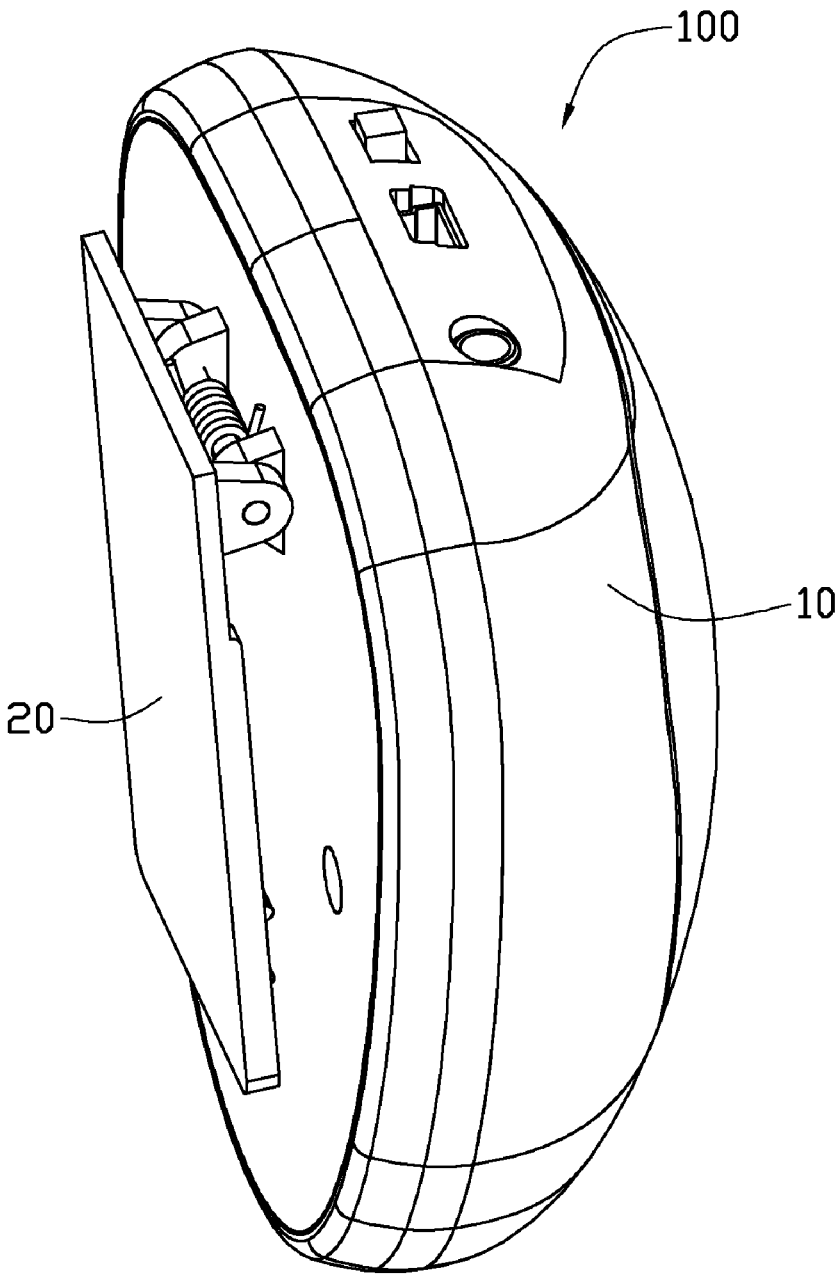
FIG. 1 is an isometric, schematic view of a sound box, according to an embodiment.

Referring to FIG. 1, a sound box 100, according to an embodiment, includes a main body 10 and a clip 20. The clip 20 is disposed on the main body 10 and configured for gripping an external object (not shown) to secure the sound box 100 to the external object.

Figure 2:
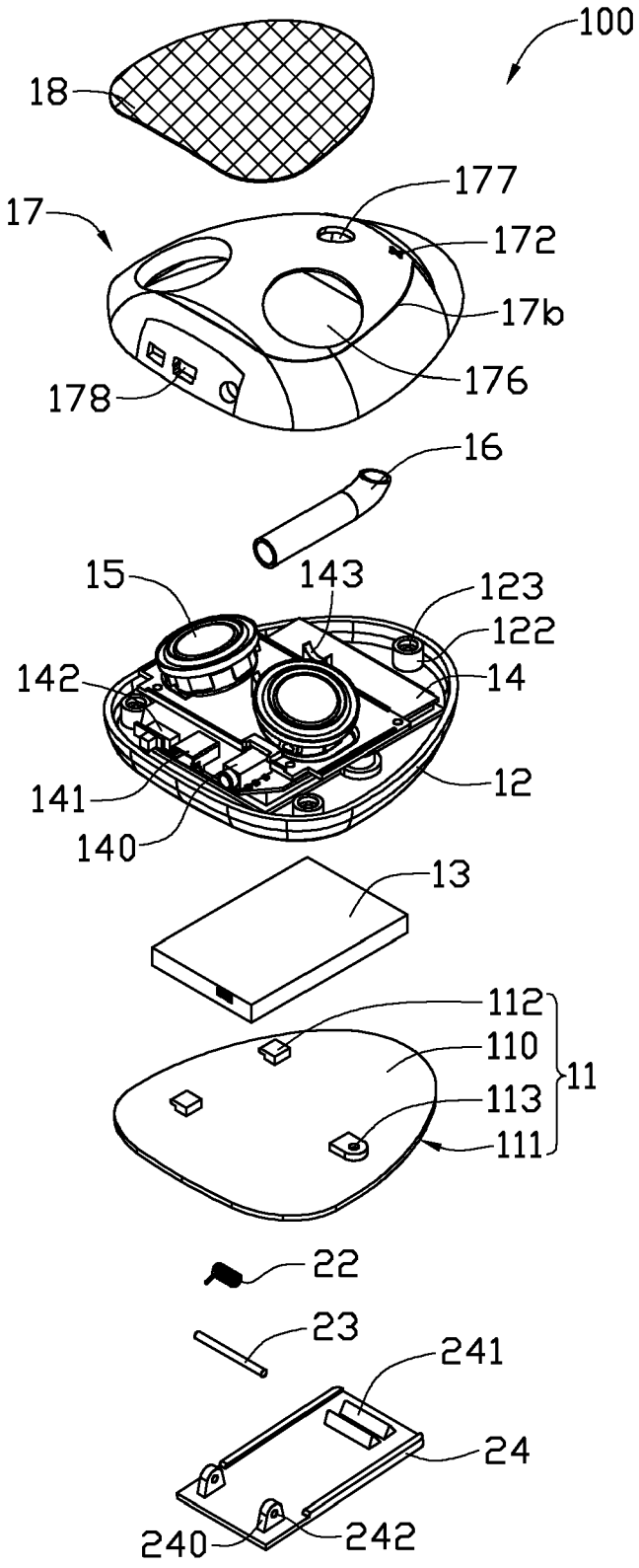
FIG. 2 is an exploded view of the sound box of FIG. 1.
Figure 3:
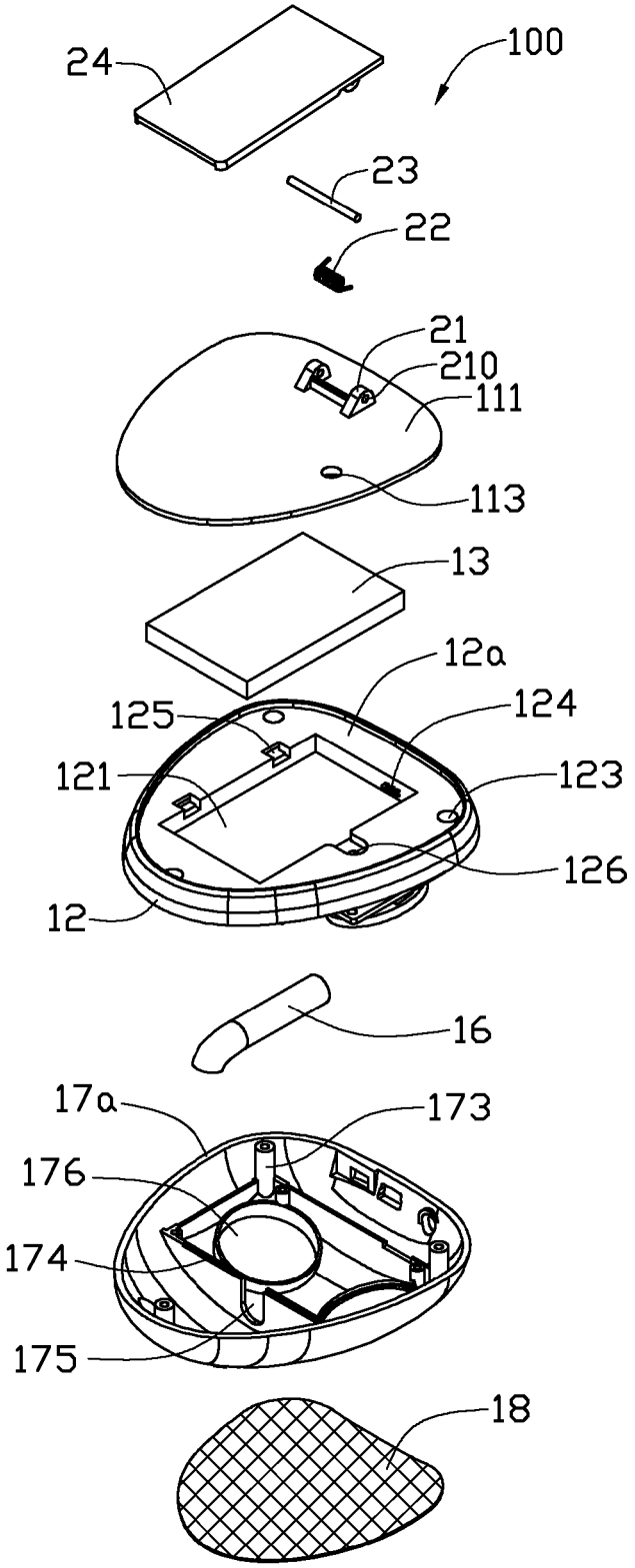
FIG. 3 is similar to FIG. 2, but viewed at another angle.
Figure 4:
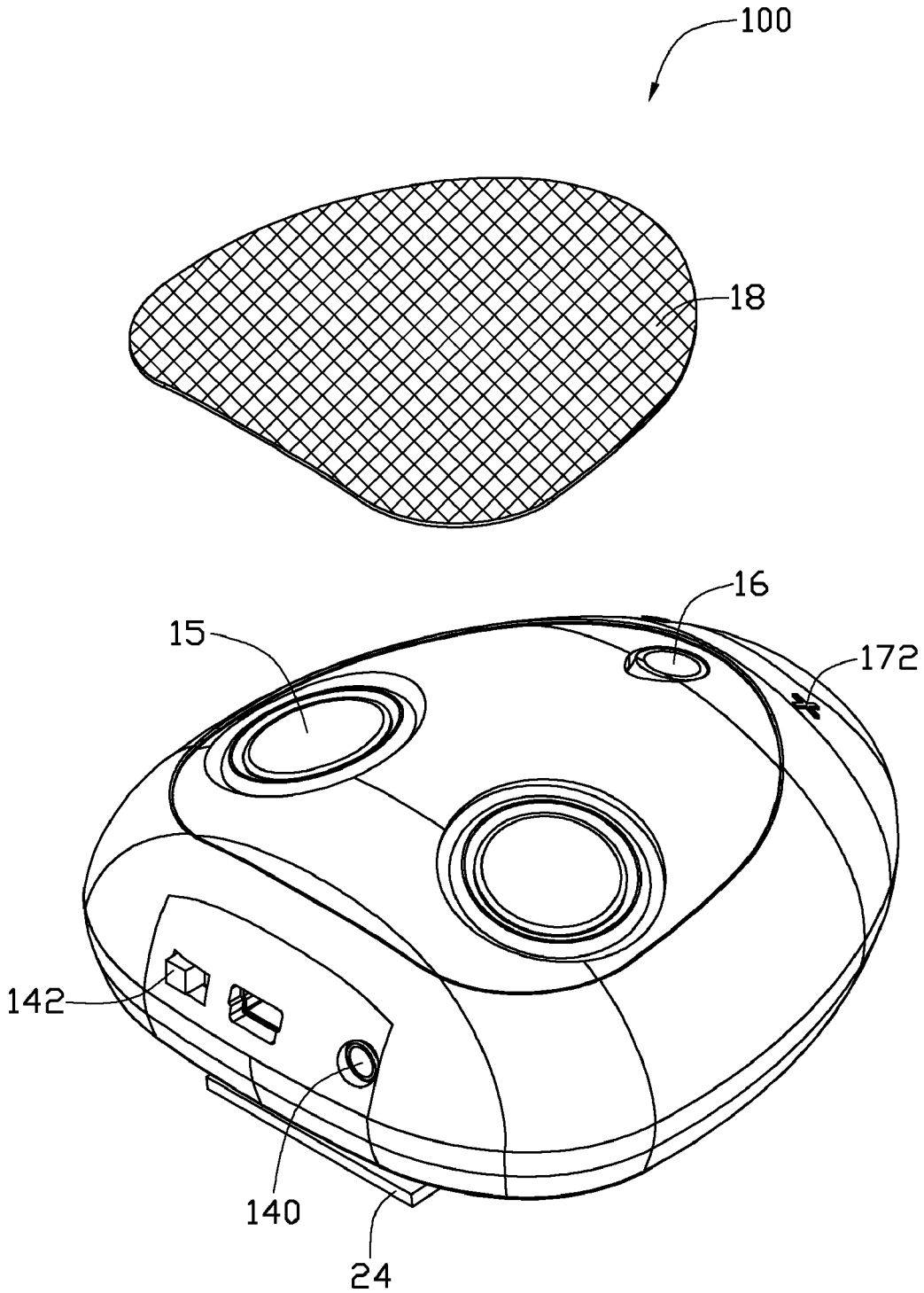
FIG. 4 is a partially assembled view of the sound box of FIG. 2.

Also referring to FIGS. 2-4, in this embodiment, the main body 10 is heart-shaped and includes a heart-shaped upper casing 17, a heart-shaped bottom plate 12, a printed circuit board (PCB) 14, two speakers 15, an inverter tube 16, a protective net 18, a battery 13, and a cover 11. The upper casing 17 defines a heart-shaped opening 17*a*. The bottom plate 12 hermetically seals the opening 17*a* to form a heart-shaped resonant chamber (not labeled) between the upper casing 17 and the bottom plate 12. The PCB 14, the speakers 15, and the inverter tube 16 are received in the resonant chamber. The PCB 14 is disposed on the bottom plate 12. The speakers 15 and the inverter tube 16 are disposed on the PCB 14. The upper casing 17 defines two first through holes 176 and a second through hole 177. The speakers 15 protrude from the upper casing 17 through the corresponding first through holes 176 and hermetically seal the corresponding first through holes 176. The inverter tube 16 protrudes from the upper casing 17 through the second through hole 177 and hermetically seal the second through hole 177.

The PCB 14 may further include a power connector 140, a data connector 141, and a power switch 142, disposed on one end of the PCB 14. The upper casing 17 defines three third through holes 178 corresponding to the power connector 140, the data connector 141, and the power switch 142, and includes a volume controller 172 mounted thereon and connected to the PCB 14. The power connector 140 protrudes from the upper casing 17 through one third through hole 178 and seals the third through hole 178 to allow the sound box 100 connecting to an external power source (not shown). The data connector 141 protrudes from the upper casing 17 through one third through hole 178 and seals the third through hole 178 to allow the sound box 100 to be connected to an audio source (not shown). The power switch 142 protrudes from the upper casing 17 through one third through hole 178 and seals the third through hole 178 to allow booting operation of the sound box 100. The volume controller 172 is disposed on the upper casing 17 to allow manual volume control of the sound box 100. However, the configuration of the power connector 140, the data connector 141, the power switch 142, and the volume controller 172 is not limited to this embodiment.

It is noteworthy that the configuration of the upper casing 17 and the bottom plate 12 is not limited to this embodiment. In other alternative embodiments, the upper casing, the bottom plate, and the opening can be designed in other shapes. Also, the numbers of the speakers 15 and the first through holes 176 are not limited to this embodiment, but should be set depending on requirements.

In particular, the bottom plate 12 includes three positioning columns 122 extending toward the upper casing 17. Each positioning column 122 defines a first through threaded hole 123. The upper casing 17 defines three fastener-receiving columns 173 extending toward and aligned with the corresponding positioning columns 122. The upper casing 17 and the bottom plate 12 are connected by inserting three fasteners (not shown) through the corresponding first through threaded holes 123 and into the corresponding fastener-receiving columns 173. Also, the upper casing 17 and the bottom plate 12 can be combined by other methods, such as, structural engagement or adhesive.

The bottom plate 12 further includes a supporter 143 disposed between the two speakers 15. The upper casing 17 includes a rib 174. The rib 174 is a plate extending toward the bottom plate 12 and positioned between the first through holes 176 and the first hole 177. The rib 174 defines a cutout 175. The inverter tube 16 is supported by the supporter 143 and extends through the cutout 175 to the second through hole 177. Thus, the inverter tube 16 is secured within the resonant chamber by the supporter 143 and the rib 174. Of course, the inverter tube 16 can be fixed in the resonant chamber by other methods in alternative embodiments.

The protective net 18 is pasted on the upper casing 17, covering the first through hole 176 and the second through hole 178 for allowing sound to exit but blocking the entry of dust. To avoid the protective net 18 adversely affecting the appearance and interfering with the handling of the sound box 100, the upper casing 17 defines a sunken surface 17*b*. The protective net 18 fittingly fills the sunken surface 17*b*.

The bottom plate 12 defines a groove 121 in a surface 12*a* facing away from the upper casing 17. The battery 13 is fittingly received in the groove 121. The cover 11 covers the surface 12*a* to secure the battery to 13 to the bottom plate 12. In particular, the bottom plate 12 also includes an electrical contact 124 that is disposed in the groove 121 and electrically connected to the PCB 14. The battery 13 is electrically connected to the PCB 14 by the electrical contact 124 and supplies power for the PCB 14. The battery 13 can be a rechargeable battery and recharged by the external power source by the power connector 141.

The bottom plate 12 defines two engagement-receiving portions 125 at one side of the groove 121 and a blind threaded hole 126 at an opposite side of the groove 121. The cover 11 is a flat board and includes a front surface 110 and a back surface 111 opposite to the front surface 110. The back cover 11 includes two engagement portions 112 disposed on the front surface 110 corresponding to the engagement-receiving portions 125. The back cover 11 also defines a second threaded through hole 113 through the front surface 110 and the rear surface 111. The cover 11 is secured to the bottom plate 12 by engaging the two engagement portions 112 with the engagement-receiving portions 125 and inserting a fastener (not shown) through the second through threaded hole 113 and into the blind threaded hole 12. Of course, the cover 11 can be secured to the bottom plate 12 by other methods.

The cover 11 includes two first connecting plates 21 extending upwards from the back surface 111, adjacent to an end of the cover 11. Each first connecting plate 21 defines a first connecting hole 210. The two first connecting holes 21 are aligned with each other. The clip 20 includes a clipping plate 24, a shaft 23, and a coil spring 22. The clipping plate 24 includes two second connecting plates 240 extending upward from a surface of the clipping plate 24, adjacent to an end of the clipping plate 24. Each second connecting plate 240 defines a second connecting hole 241. The second connecting holes 241 are aligned with each other. The distance between the second connecting plates 240 is slightly farther than between the first connecting plates 21. The shaft 23 extends through one second connecting hole 240, one first connecting hole 210, the coil spring 22, the other first connecting hole 210, and the other second connecting hole 240 in sequence. Thus, the clipping plate 24 is connected to the cover 11. The coil spring 22 is configured for applying a torsional force to the clipping plate 24 so that an end of the clipping plate 24 opposite to the second connecting plate 240 abuts the cover 11. In this embodiment, the clipping plate 24 further includes two gripping teeth 241 formed at the end of the clipping plate 12 opposite to the second connecting plates 240 to increase a gripping force of the clip 20.

It will be understood that the above particular embodiments and methods are shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. A portable sound box comprising:

a main body comprising an upper casing, a bottom plate, a printed circuit board, a speaker, an inverter tube, and a cover; the upper casing and the bottom plate cooperatively defining a resonant chamber therebetween; the upper casing defining a first through hole and a second through hole; the printed circuit board, the speaker, and the inverter tube being received in the resonant chamber; the printed circuit board being disposed on the bottom plate; the speaker and the inverter tube being disposed on the printed circuit board; the speaker sealing the first through hole; the inverter tube sealing the second through hole; the bottom plate defining a groove in a surface thereof opposite to the upper casing for receiving a battery, the cover covering the surface; the bottom plate comprising an electrical contact disposed in the groove and configured for connecting the battery to the printed circuit board; and a clip disposed on the cover for gripping an external object to secure the portable sound box to the external object.

2. The portable sound box of claim 1, further comprising a protective net disposed on the upper casing and covering the first through hole and the second through hole.

3. The portable sound box of claim 2, wherein the upper casing defines a sunken surface; the protective net is fittingly pasted to the sunken surface.

4. The portable sound box of claim 1, wherein the printed circuit board comprises a power connector; the upper casing defining a third through hole corresponding to the power connector; the power connector protruding outside the upper casing through the third through hole and sealing the third through hole to allow the sound box connecting to an external power source.

5. The portable sound box of claim 4, wherein the battery is a rechargeable battery and is recharged by the external power source by the power connector.

6. The portable sound box of claim 1, wherein the printed circuit board comprises a data connector; the upper casing defining a third through hole corresponding to the data connector; the data connector protruding from the upper casing through the third through hole and sealing the third through hole to allow the sound box to be connected to an audio source.

7. The portable sound box of claim 1, wherein the printed circuit board comprises a power switch; the upper casing defining a third through hole corresponding to the power switch; the power switch protruding from the upper casing through the third through hole and sealing the third through hole to allow booting the sound box.

8. The portable sound box of claim 1, wherein the printed circuit board comprises a volume controller disposed on the upper casing; the volume controller being configured for controlling volume of the sound box.

9. The portable sound box of claim 1, wherein the cover comprising two first connecting plates extending upwards from a surface opposite to the bottom plate, adjacent to an end of the cover; each first connecting plate defining a first connecting hole; the two first connecting holes being aligned with each other; the clip comprising a clipping plate, a shaft, and a coil spring; the clipping plate comprising two second connecting plates extending upward from a surface thereof, adjacent to an end thereof, each second connecting plate defining a second connecting hole; the second connecting holes being aligned with each other; the distance between the second connecting plates being slightly larger than that of the first connecting plates; the shaft inserting through one second connecting hole, one first connecting hole, the coil spring, the other first connecting hole, and the other second connecting hole in sequence; the coil spring being configured for applying a torsional force to the clipping plate so that an end of the clipping plate opposite to the second connecting plates abuts the cover.

10. The portable sound box of claim 9, wherein the clipping plate comprises two gripping teeth formed at the end of the clipping plate opposite to the second connecting plates.

* * * * *